US005804912A

United States Patent [19]

Park

[11] Patent Number: 5,804,912

[45] Date of Patent: Sep. 8, 1998

[54] MAGNETIC SHIELDING CRT

[75] Inventor: Dong Min Park, Kyeongsangnam-do, Rep. of Korea

[73] Assignee: Samsung Display Devices Co., Ltd., Kyungki-do, Rep. of Korea

[21] Appl. No.: 730,219

[22] Filed: Oct. 15, 1996

[30] Foreign Application Priority Data

Nov. 8, 1995 [KR] Rep. of Korea ..... 95-40326

[51] Int. Cl.[6] ..... H01J 29/06; C22C 38/06

[52] U.S. Cl. ..... 313/402; 313/479; 313/407; 148/307

[58] Field of Search ..... 313/402, 477 R, 313/478, 479, 480, 635; 315/85; 348/819, 820

[56] References Cited

U.S. PATENT DOCUMENTS

| | | | |
|---|---|---|---|
| 4,949,008 | 8/1990 | Chihara | 313/402 |
| 5,097,174 | 3/1992 | D'Amato | 313/402 |
| 5,187,012 | 2/1993 | Takahashi et al. | 428/402 |
| 5,207,841 | 5/1993 | Shigeta et al. | 148/307 |
| 5,235,243 | 8/1993 | Tong | 313/402 |
| 5,252,148 | 10/1993 | Shigeta et al. | 148/307 |
| 5,557,161 | 9/1996 | Van Mensvoort | 313/479 |

*Primary Examiner*—Sandra L. O'Shea
*Assistant Examiner*—Mack Haynes
*Attorney, Agent, or Firm*—Christie, Parker & Hale, LLP

[57] ABSTRACT

A magnetic cathode ray tube (CRT) which has an iron or cobalt based amorphous alloy layer on the surface of a glass bulb shows an excellent magnetic shielding effect and has simple structure.

6 Claims, 1 Drawing Sheet

MAGNETIC SHIELDING CRT

BACKGROUND OF THE INVENTION (1) Field of the Invention

The present invention relates to a magnetic shielding CRT (cathode ray tube), particularly to a novel magnetic CRT having a simple structure and showing superior magnetic shielding effect by means of forming an iron (Fe) or cobalt (Co) based amorphous alloy layer on the inner and/or outer surface of a glass bulb to conventional magnetic shielding CRTs which have a magnetic shield on a shadow mask of an inner layer of a glass bulb.

(2) Description of the Related Art

A cathode ray tube (CRT) is generally used as an image display unit of televisions, computer monitors, etc. A CRT emits visible rays when electron beams emitted from an electron gun hit a phosphor screen. As shown in FIG. 1, a CRT includes a phosphor screen panel (1) for showing an image, an electron gun (5) for emitting, focusing and controlling electron beams, a deflection coil (6) for controlling a traveling direction of electron beams, a shadow mask (4) (for color CRTs) for chopping electron beams, a phosphor screen, a glass bulb (2) for sustaining the above parts and maintaining constant inner conditions and a magnetic shield (3) for shielding against the external magnetic field.

An iron panel having a purity of above 99% or a silicon panel is used as a magnetic shield. As shown in FIG. 1, a magnetic shield (3) is attached to a mounting pin of a shadow mask in a glass bulb to prevent the traveling direction of electron beams emitted from an electron gun from distorting by the external magnetic field.

However, the shielding effect against the external magnetic field by using the above magnetic shield is insufficient and the process for preparing the CRT having the conventional magnetic shield is complicated.

SUMMARY OF THE INVENTION

It is an object of the present invention to provide a magnetic shielding CRT having a simple structure and having preferable shielding effect against the external magnetic field.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE INVENTION

To achieve the above object, in a cathode ray tube (CRT) comprising a phosphor screen panel for showing an image, an electron gun for emitting, focusing and controlling electron beams, a deflection coil for controlling the traveling direction of electron beams, a shadow mask (for color CRTs) for chopping electron beams, a phosphor screen, and a glass bulb for sustaining the above parts and maintaining constant inner conditions, the present invention further comprises a CRT in which an iron or cobalt based amorphous alloy coating layer is formed on the surface of a glass bulb.

The iron or cobalt based amorphous alloy is non-crystalline like glass which has no crystal in the ambient temperature. Namely, the iron or cobalt based amorphous alloy is commonly used as material to produce audio cartridges, magnetic heads for video cassette tape recorders or magnetic recording headers of computers because it is a soft magnetic material and has the properties of low coercive force, high magnetic permeability, low hysteresis loss, high electric resistance and no magnetic anisotropy.

In the present invention, the above iron or cobalt based amorphous alloy is used to shield a magnetism. Further, the alloy is prepared in the form of a thin layer by means of a vacuum evaporation process.

The kinds of the iron or cobalt based amorphous alloy which can be used in the present invention are $Fe_{78}Si_9B_{13}$, $Fe_{81}B_{13.5}Si_{3.5}C_2$, $Fe_{86}B_7C_7$, $Co_{70.3}Fe_{4.7}Si_{15}B_{10}$, $Co_{61.6}Fe_{4.2}Ni_{4.2}Si_{10}B_{20}$, $Co_{67}Fe_{4.58}Ni_{1.5}Nb_2Si_{10}B_{15}Co_{83.5}Nb_{12.4}Zr_{4.1}$ and alloys thereof.

In the present invention, these coating layers can be formed on the inner and/or outer surface of a glass bulb and the coating thickness of 30 to 50 $\mu$m is preferable.

Figure 1:
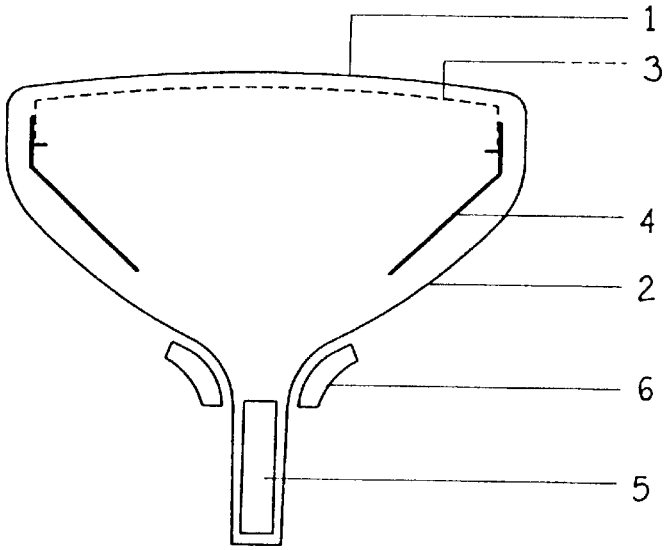
FIG. 1 (Prior Art)
FIG. 1 is a cross sectional view of a conventional CRT having a magnetic shield.
Figure 2:
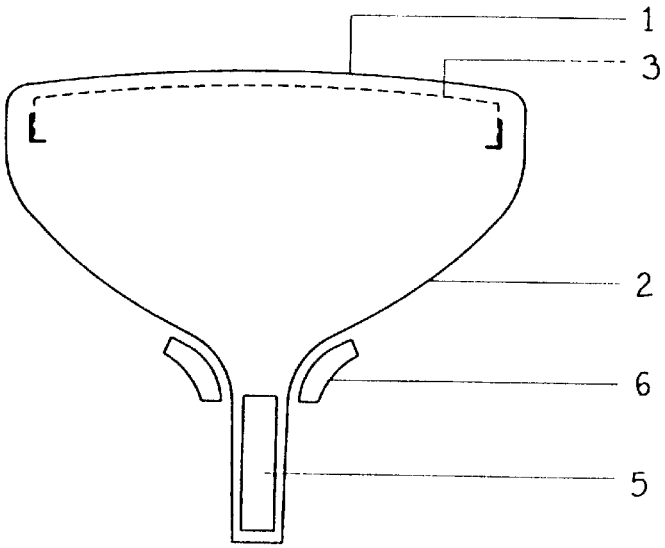
FIG. 2 is a cross sectional view of a magnetic shielding CRT according to the present invention.
Figure 2:
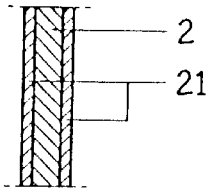

As shown in FIG. 2, the CRT prepared by the principles of the present invention has a simple structure compared with the conventional CRT of FIG. 1.

What is claimed is:

1. A cathode ray tube comprising:

a phosphor screen panel for showing an image;

an electron gun for emitting, focusing and controlling electron beams;

a deflection coil for controlling a traveling direction of electron beams; and a glass bulb for sustaining the electron gun, deflection coil, and phosphor screen and maintaining constant inner conditions, wherein the glass bulb comprises an iron based amorphous alloy layer disposed on surfaces selected from the group consisting of the inner surface, the outer surface, and combinations thereof and wherein the iron based amorphous alloy is selected from the group consisting of $Fe_{78}Si_9B_{13}$, $Fe_{81}B_{13.5}Si_{7.5}C_2$, $F_{86}B_7C_7$, and alloys thereof.

2. The CRT as claimed in claim 1, said iron based amorphous alloy layer is formed by a vacuum evaporation process.

3. The CRT as claimed in claim 1, the thickness of said iron based amorphous alloy layer is 30 to 50 $\mu$m.

4. A cathode ray tube comprising:

a phosphor screen panel for showing an image;

an electron gun for emitting, focusing and controlling electron beams;

a deflection coil for controlling a traveling direction of electron beams; and a glass bulb for sustaining the electron gun, deflection coil, and phosphor screen and maintaining constant inner conditions, wherein the glass bulb comprises a cobalt based amorphous alloy layer disposed on surfaces selected from the group consisting of the inner surface, the outer surface, and combinations thereof, and wherein the cobalt based amorphous alloy is selected from the group consisting of $Co_{61.6}Fe_{4.2}Ni_{4.2}Si_{10}B_{10}$, $Co_{67.6}Fe_{4.5}Ni_{1.9}Nb_{2.2}Si_{10}$, $B_{15}Co_{83.5}Nb_{12.4}Zr_{4.1}$, $Co_{86}Ta_9Zr_5$, and alloys thereof.

5. The CRT as claimed in claim 4, said cobalt based amorphous alloy layer is formed by a vacuum evaporation process.

6. The CRT as claimed in claim 4, the thickness of said cobalt based amorphous alloy layer is 30 to 50 $\mu$m.

* * * * *